US005886637A

United States Patent [19]

Stuckey

[11] Patent Number: 5,886,637

[45] Date of Patent: Mar. 23, 1999

[54] DOOR WITH BUILT-IN SMOKE AND FIRE DETECTOR

[76] Inventor: Scott R. Stuckey, 54730 Belmont St., Martins Ferry, Ohio 43935

[21] Appl. No.: 1,427

[22] Filed: Dec. 31, 1997

[51] Int. Cl.[6] ..... G08B 17/10

[52] U.S. Cl. ..... 340/628; 340/577; 340/584; 340/694; 340/693

[58] Field of Search ..... 340/577, 578, 340/579, 584, 628, 629, 630, 632, 691, 693

[56] References Cited

U.S. PATENT DOCUMENTS 4,319,234 3/1982 Rice ..... 340/628
4,540,980 9/1985 Porco ..... 340/628
4,855,715 8/1989 S'evigny ..... 340/545
4,968,975 11/1990 Fritz ..... 340/628

*Primary Examiner*—Daniel J. Wu

[57] ABSTRACT

A new door with built-in smoke and fire detector for incorporating a smoke and fire detector into a door. The inventive device includes a door having a generally rectangular configuration. The door includes front and rear surfaces. The door includes a short upper edge, a short lower edge, and long opposed side edges. The short upper edge has a recess extending inwardly thereof. The front and rear surfaces have a plurality of openings therethrough in communication with the recess. An alarm system is coupled with respect to the recess in the short upper edge of the housing.

8 Claims, 2 Drawing Sheets

DOOR WITH BUILT-IN SMOKE AND FIRE DETECTOR

BACKGROUND OF THE INVENTION

1. Field of the Invention

The present invention relates to fire and smoke detectors and more particularly pertains to a new door with built-in smoke and fire detector for incorporating a smoke and fire detector into a door.

2. Description of the Prior Art

The use of fire and smoke detectors is known in the prior art. More specifically, fire and smoke detectors heretofore devised and utilized are known to consist basically of familiar, expected and obvious structural configurations, notwithstanding the myriad of designs encompassed by the crowded prior art which have been developed for the fulfillment of countless objectives and requirements.

Known prior art fire and smoke detectors include U.S. Pat. No. 4,855,715 to Sevigny; U.S. Pat. No. 4,706,413 to James; U.S. Pat. No. 4,611,200 to Stilwell; U.S. Pat. No. 4,649,376 to Frank; U.S. Pat. No. 4,540,980 to Porco; and U.S. Pat. No. Des. 248,320 to Sticjtenoth.

While these devices fulfill their respective, particular objectives and requirements, the aforementioned patents do not disclose a new door with built-in smoke and fire detector. The inventive device includes a door having a generally rectangular configuration. The door includes front and rear surfaces. The door includes a short upper edge, a short lower edge, and long opposed side edges. The short upper edge has a recess extending inwardly thereof. The front and rear surfaces have a plurality of openings therethrough in communication with the recess. An alarm system is coupled with respect to the recess in the short upper edge of the housing.

In these respects, the door with built-in smoke and fire detector according to the present invention substantially departs from the conventional concepts and designs of the prior art, and in so doing provides an apparatus primarily developed for the purpose of incorporating a smoke and fire detector into a door.

SUMMARY OF THE INVENTION

In view of the foregoing disadvantages inherent in the known types of fire and smoke detectors now present in the prior art, the present invention provides a new door with built-in smoke and fire detector construction wherein the same can be utilized for incorporating a smoke and fire detector into a door.

The general purpose of the present invention, which will be described subsequently in greater detail, is to provide a new door with built-in smoke and fire detector apparatus and method which has many of the advantages of the fire and smoke detectors mentioned heretofore and many novel features that result in a new door with built-in smoke and fire detector which is not anticipated, rendered obvious, suggested, or even implied by any of the prior art fire and smoke detectors, either alone or in any combination thereof.

To attain this, the present invention generally comprises a door having a generally rectangular configuration. The door includes front and rear surfaces. The door includes a short upper edge, a short lower edge, and long opposed side edges. The short upper edge has a recess extending inwardly thereof. The front and rear surfaces have a plurality of openings therethrough in communication with the recess. An alarm system is coupled with respect to the recess in the short upper edge of the housing. The alarm system includes a housing that is dimensioned for being received within the recess of the door. The alarm system includes alarm circuitry positioned interiorly of the housing. The alarm system is powered by batteries disposed within the housing. The housing includes a door to facilitate access to the batteries. The alarm system includes smoke sensors extending outwardly of the openings in the front and rear surfaces of the door. The smoke sensors are in communication with the alarm circuitry. The alarm system includes speakers extending outwardly of the openings in the front and rear surfaces of the door. The speakers are in communication with the alarm circuitry. The alarm system includes lights extending outwardly of the openings in the front and rear surfaces of the door. The lights are in communication with the alarm circuitry. The alarm system includes a test button extending outwardly of a top wall of the housing. The test button is in communication with the alarm circuitry.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new door with built-in smoke and fire detector apparatus and method which has many of the advantages of the fire and smoke detectors mentioned heretofore and many novel features that result in a new door with built-in smoke and fire detector which is not anticipated, rendered obvious, suggested, or even implied by any of the prior art fire and smoke detectors, either alone or in any combination thereof.

It is another object of the present invention to provide a new door with built-in smoke and fire detector which may be easily and efficiently manufactured and marketed.

It is a further object of the present invention to provide a new door with built-in smoke and fire detector which is of a durable and reliable construction.

An even further object of the present invention is to provide a new door with built-in smoke and fire detector which is susceptible of a low cost of manufacture with regard to both materials and labor, and which accordingly is then susceptible of low prices of sale to the consuming public, thereby making such door with built-in smoke and fire detector economically available to the buying public.

Still yet another object of the present invention is to provide a new door with built-in smoke and fire detector which provides in the apparatuses and methods of the prior art some of the advantages thereof, while simultaneously overcoming some of the disadvantages normally associated therewith.

Still another object of the present invention is to provide a new door with built-in smoke and fire detector for incorporating a smoke and fire detector into a door.

Yet another object of the present invention is to provide a new door with built-in smoke and fire detector which includes a door having a generally rectangular configuration. The door includes front and rear surfaces. The door includes a short upper edge, a short lower edge, and long opposed side edges. The short upper edge has a recess extending inwardly thereof. The front and rear surfaces have a plurality of openings therethrough in communication with the recess. An alarm system is coupled with respect to the recess in the short upper edge of the housing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
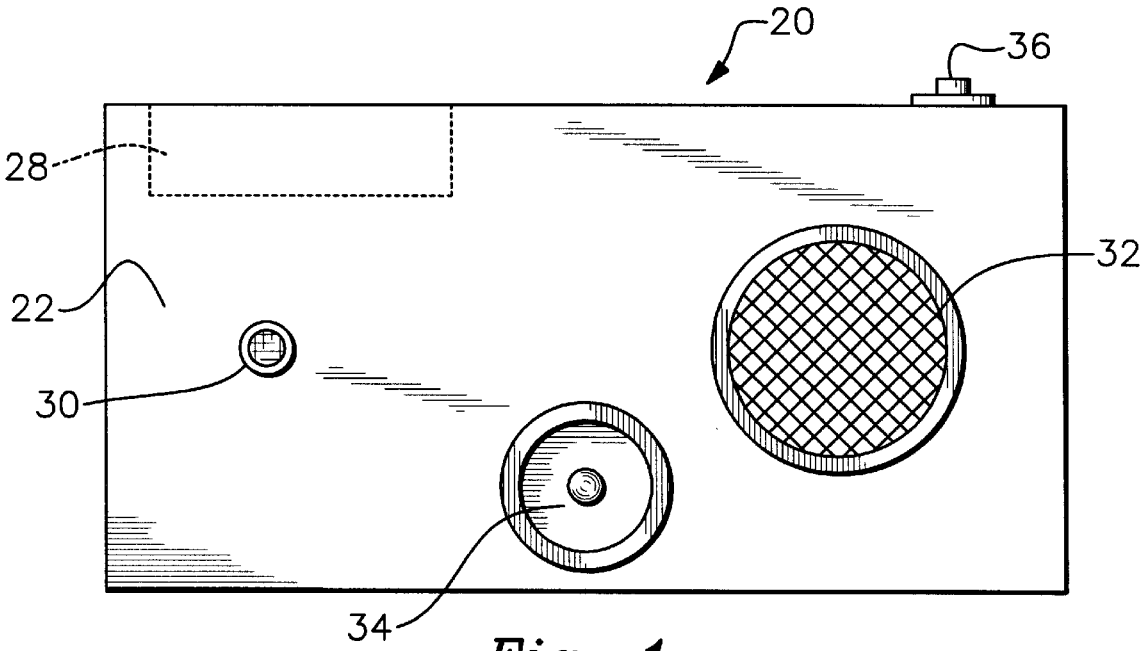
FIG. 1 is a front elevation view of the housing of a new door with built-in smoke and fire detector according to the present invention.
Figure 2:
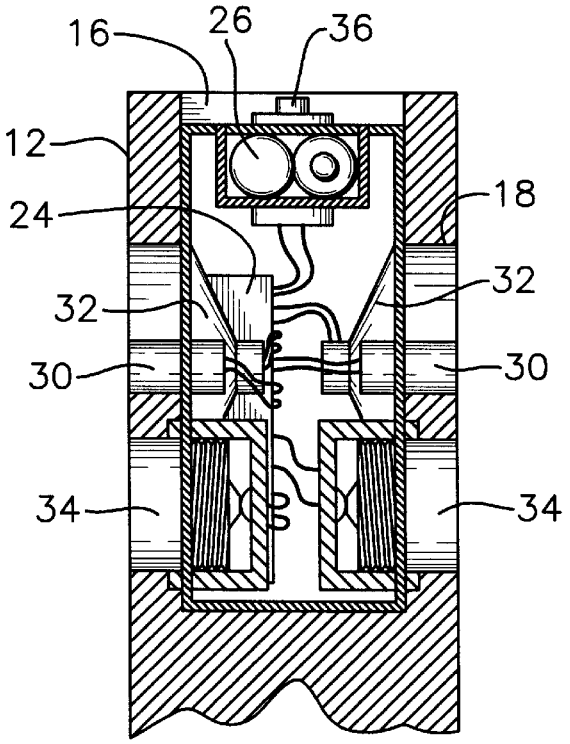
FIG. 2 is a cross-sectional view of the housing of the present invention as shown in FIG. 1.
Figure 3:
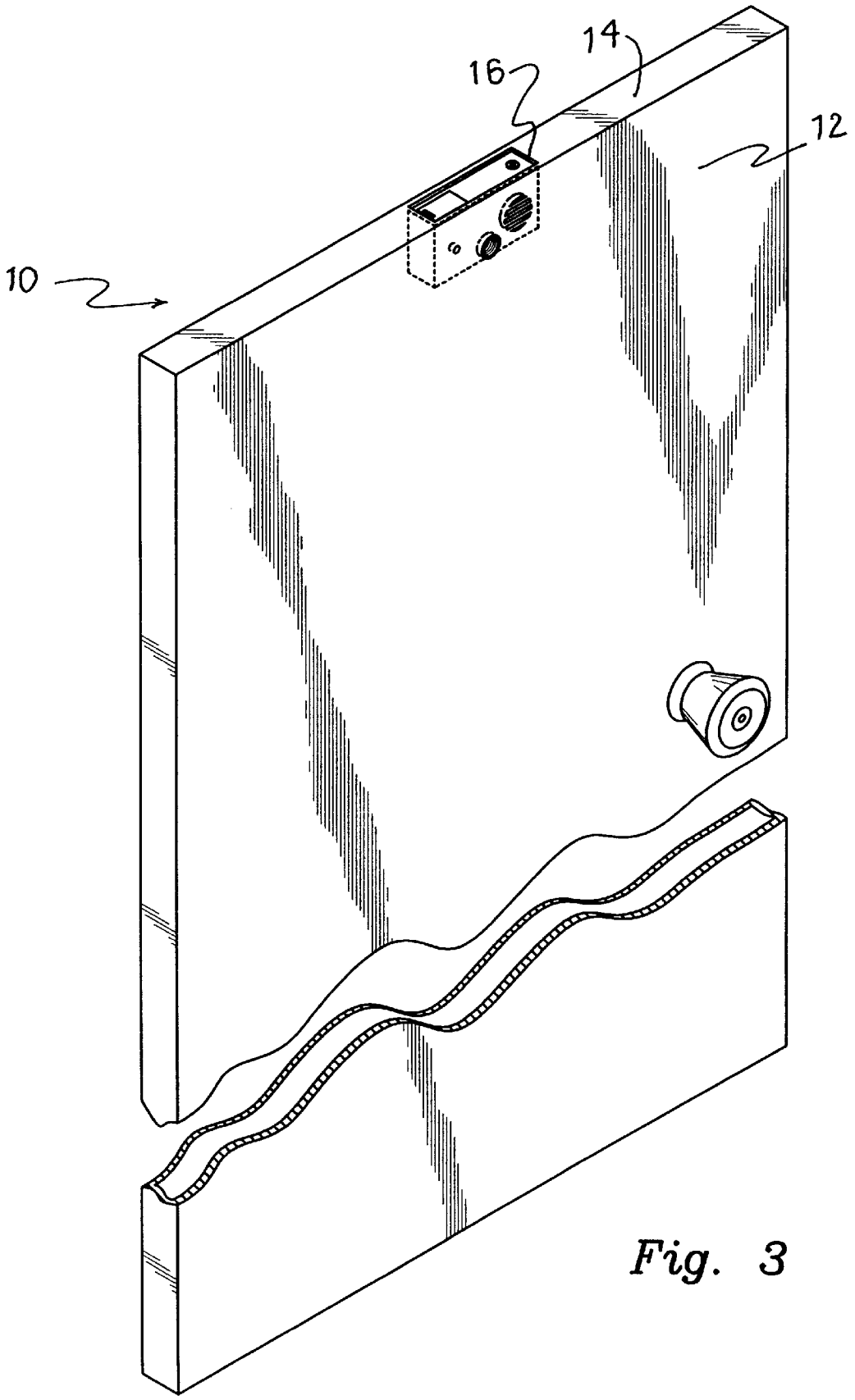
FIG. 3 is a perspective view of the present invention illustrating the door thereof.

With reference now to the drawings, and in particular to FIGS. 1 through 3 thereof, a new door with built-in smoke and fire detector embodying the principles and concepts of the present invention and generally designated by the reference numeral 10 will be described.

As best illustrated in FIGS. 1 through 3, the door with built-in smoke and fire detector 10 comprises a door 12 having a generally rectangular configuration. The door 12 includes front and rear surfaces. The door 12 includes a short upper edge 14, a short lower edge, and long opposed side edges. The short upper edge 14 has a recess 16 extending inwardly thereof. The front and rear surfaces have a plurality of openings 18 therethrough in communication with the recess 16.

An alarm system 20 is coupled with respect to the recess 16 in the short upper edge 14 of the housing 12. The alarm system 20 includes a housing 22 that is dimensioned for being received within the recess 16 of the door 12. The alarm system 20 includes alarm circuitry 24 positioned interiorly of the housing 22. The alarm system 20 is powered by batteries 26 disposed within the housing 22. The housing 22 includes a door 28 to facilitate access to the batteries 26. The alarm system 20 includes smoke sensors 30 extending outwardly of the openings 18 in the front and rear surfaces of the door 12. The smoke sensors 30 are in communication with the alarm circuitry 24. The alarm system 20 includes speakers 32 extending outwardly of the openings 18 in the front and rear surfaces of the door 12. The speakers 32 are in communication with the alarm circuitry 24. The alarm system 20 includes lights 34 extending outwardly of the openings 18 in the front and rear surfaces of the door 12. The lights 34 are in communication with the alarm circuitry 24. The alarm system 20 includes a test button 36 extending outwardly of a top wall of the housing 22. The test button 36 is in communication with the alarm circuitry 24.

In use, the smoke sensors 30 would trigger a loud audible alarm through the speakers 32 in the event of a fire being detected on either side of the door 12. The alarm would be broadcast to both sides of the door 12. Consequently, the present invention could ensure that an individual on one side of a door 12 would hear an alert of a fire located on the other side of the door 12. The detection of smoke would not only trigger the alarm, but would also activate the lights 34 on both sides of the door 12. Thus, in the vent of a smoke-filled room, the lights 34 will shine so that the individual can still see the door 12 in order to exit the room. The present invention includes other traditional elements of a smoke detector, such as a test button 36 and battery operation. A removable cover could also be included for the recess 16 in the door 12 to enclose the alarm system 20 therein.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new door with built-in smoke and fire detector for incorporating a smoke and fire detector into a door comprising, in combination:

a door having a generally rectangular configuration, the door including front and rear surfaces, the door including a short upper edge, a short lower edge, and long opposed side edges, the short upper edge having a recess extending inwardly thereof, the front and rear surfaces having a plurality of openings therethrough in communication with the recess;

an alarm system coupled with respect to the recess in the short upper edge of the housing, the alarm system including a housing dimensioned for being received within the recess of the door, the alarm system including alarm circuitry positioned interiorly of the housing, the alarm system being powered by batteries disposed within the housing, the housing including a door to facilitate access to the batteries, the alarm system including smoke sensors extending outwardly of the openings in the front and rear surfaces of the door, the smoke sensors being in communication with the alarm circuitry, the alarm system including speakers extending outwardly of the openings in the front and rear surfaces of the door, the speakers being in communication with the alarm circuitry, the alarm system including lights extending outwardly of the openings in the front and rear surfaces of the door, the lights being in communication with the alarm circuitry, the alarm system including a test button extending outwardly of a top wall of the housing, the test button being in communication with the alarm circuitry.

2. A new door with built-in smoke and fire detector for incorporating a smoke and fire detector into a door comprising, in combination:

a door having a generally rectangular configuration, the door including front and rear surfaces, the door including a short upper edge, a short lower edge, and long opposed side edges, the short upper edge having a recess extending inwardly thereof, the front and rear surfaces having a plurality of openings therethrough in communication with the recess;

an alarm system coupled with respect to the recess in the short upper edge of the housing.

3. The door with built-in smoke and fire detector as set forth in claim 2 wherein the alarm system includes a housing dimensioned for being received within the recess of the door, the alarm system including alarm circuitry positioned interiorly of the housing.

4. The door with built-in smoke and fire detector as set forth in claim 3 wherein the alarm system is powered by batteries disposed within the housing, the housing including a door to facilitate access to the batteries.

5. The door with built-in smoke and fire detector as set forth in claim 3 wherein the alarm system includes smoke sensors extending outwardly of the openings in the front and rear surfaces of the door, the smoke sensors being in communication with the alarm circuitry.

6. The door with built-in smoke and fire detector as set forth in claim 3 wherein the alarm system include speakers extending outwardly of the openings in the front and rear surfaces of the door, the speakers being in communication with the alarm circuitry.

7. The door with built-in smoke and fire detector as set forth in claim 3 wherein the alarm system includes lights extending outwardly of the openings in the front and rear surfaces of the door, the lights being in communication with the alarm circuitry.

8. The door with built-in smoke and fire detector as set forth in claim 3 wherein the alarm system includes a test button extending outwardly of a top wall of the housing, the test button being in communication with the alarm circuitry.

* * * * *